US005749923A

United States Patent [19]

Olip et al.

[11] Patent Number: 5,749,923

[45] Date of Patent: May 12, 1998

[54] METHOD FOR BLEACHING DENIM TEXTILE MATERIAL

[75] Inventors: Vinzenz Olip, Schächtestrasse, Austria; Norbert Steiner, Upper Saddle River, N.J.

[73] Assignee: Degussa Aktiengellschaft, Frankfurt am Main, Germany

[21] Appl. No.: 651,785

[22] Filed: May 24, 1996

Related U.S. Application Data

[63] Continuation of Ser. No. 347,146, Nov. 22, 1994, Pat. No. 5,549,715.

[30] Foreign Application Priority Data

Nov. 23, 1993 [AT] Austria ..... AT 2378/93

[51] Int. Cl.[6] ..... D06L 3/10

[52] U.S. Cl. ..... 8/102; 8/107; 8/110; 8/111; 510/302; 510/303; 510/494; 510/367; 510/370; 510/470

[58] Field of Search ..... 8/102, 107, 110, 8/111; 510/302, 303, 494, 367, 370, 470

[56] References Cited

U.S. PATENT DOCUMENTS

| | | | |
|---|---|---|---|
| 4,155,710 | 5/1979 | Komninos et al. | 8/586 |
| 4,240,791 | 12/1980 | Sato et al. . | |
| 4,314,804 | 2/1982 | Fennekels et al. . | |
| 4,852,990 | 8/1989 | Patterson . | |
| 4,912,056 | 3/1990 | Olson . | |
| 5,006,126 | 4/1991 | Olson et al. . | |
| 5,264,001 | 11/1993 | Arifoglu et al. . | |
| 5,338,491 | 8/1994 | Connor et al. | 510/299 |
| 5,366,510 | 11/1994 | Wasinger et al. | 8/110 |
| 5,519,925 | 5/1996 | Ball et al. | 28/299 |
| 5,549,715 | 8/1996 | Olip | 8/110 |

FOREIGN PATENT DOCUMENTS

| | | |
|---|---|---|
| 0175272 | 3/1986 | European Pat. Off. . |
| 2011387 | 10/1970 | Germany . |
| 2165154 | 7/1973 | Germany . |
| 3831098 | 3/1990 | Germany . |
| 3833194 | 4/1990 | Germany . |

OTHER PUBLICATIONS

Federal Law Gazette, No. 612, Sep. 24, 1992, "Limitation of Waste Water Emissions from Textile Finishing and Processing Plants".

Peter, M., et al. *Grundlagen der Textilveredelung* [*Basics of Textile Finishing*,]13th ed., Deutscher Fachverlag, 1989, pp. 80 to 81. (Month Unknown).

Derwent Acc. No. 80–24863C, 1980 (month unknown).

Derwent Acc. No. 86–268586, 1986 (Month Unknown).

Derwent Acc. No. 89–155166, 1989 (Month Unknown).

Das, T.K., et al., "Thiourea Dioxide: A Powerful And Safe Reducing Agent For Textile Applications", *Colourage,* vol. 31, No. 26, 1984, pp. 15–20. (Month Unknown).

Weiss, M., "Thiourea Dioxide: A Safe Alternative To Hydrosulfite Reduction", Part 1, *American Dyestuff Reporter,* vol. 67, No. 8, Aug. 1978, pp. 35–38.

Weiss, M., "Thiourea Dioxide: A Safe Alternative to Hydrosulfite Reduction, Part II", *American Dyestuff Reporter,* vol. 67, No. 9, Sep. 1978, pp. 72–74.

*Primary Examiner*—Alan Diamond

*Attorney, Agent, or Firm*—Spencer & Frank

[57] ABSTRACT

A method for chlorine-free bleaching of denim textile material composed of warp yarn which is dyed with at least one of (a) indigo dye and at least one sulfur dye, and (b) at least one derivative of indigo dye and at least one sulfur dye, and weft yarn which is undyed and substantially white and which continues to be substantially white after bleaching to provide a denim textile material having a stylish gray cast. The method includes placing denim textile material in water and heating; adding to the water a dispersing agent which is effective to retard deposition of dyestuff stripped from the warp yarn during bleaching onto the weft yarn and which is comprised of polyvinylpyrrolidone; and bleaching the denim textile material by adding to the water an aqueous alkaline bleaching agent which contains a bleaching agent which is selective for the indigo dye or the derivative of indigo dye of the warp yarn and which is selected from the group consisting of formamidine sulfinic acid, and a mixture of formamidine sulfinic acid and at least one reducing carbohydrate, wherein the least one sulfur dye includes a sulfur black dye, and wherein the method provides denim textile material having a stylish gray cast.

26 Claims, No Drawings

METHOD FOR BLEACHING DENIM TEXTILE MATERIAL

CROSS REFERENCE TO RELATED APPLICATION

This application is a continuation-in-part of application Ser. No. 08/347,146 filed Nov. 22, 1994 by Vinzenz Olip, now U.S. Pat. No. 5,549,715 issued Aug. 27, 1996, which claims the benefit of priority from Application No. A 2378/93 filed Nov. 23, 1993 in Austria, the disclosure of which is incorporated by reference. This Application additionally claims the benefit of copending Provisional application Ser. No. 60/004,961 filed Oct. 6, 1995, the disclosure of which is incorporated by reference.

BACKGROUND OF THE INVENTION

1. Field of the Invention

The present invention relates to a method for bleaching textile material with reducing agents, in particular denim textile material comprised of indigo-dyed warp yarn, or indigo in combination with sulfur-dyed warp yarn, and undyed, substantially white weft yarn.

2. Description of the Related Art

Inspired by modern processing technology and driven by the demand for stylish textile designs produced by means of washing, bleaching and dyeing, efforts are ongoing to vary denim garments and produce, for example, a worn look. Denim is a warp and weft weaving technique wherein the warp consists of a cotton yarn dyed with a blue dye and the weft consists of an undyed, substantially white cotton yarn. The weft may be pretreated, for example, by extraction with a caustic solution to remove hemicelluloses and seeds. Blue denim, a fabric often used for producing blue jeans, is a three-leaf warp body (K 2s/1), for example, which has a warp which is dyed blue by means of indigo dye or a combination of indigo dye and sulfur black or sulfur blue dyes mainly on the fabric surface. As examples of sulfur black dyes typically employed mention is made of Ultra Black and Indigo Black. As an example of sulfur blue dyes typically employed mention is made of Indigo Blue. When the combination of indigo and sulfur dyes is employed to produce the blue dyed warp, the sequence of dying the yarn is spoken of as sulfur bottom dyed yarn (sulfur dye being applied first) or sulfur top dyed yarn (sulfur dye being applied after the indigo dye). The substantially white weft is visible on the underside of the fabric in contrast to the blue dyed fabric topside.

Industrial laundries have heretofore attempted to produce stylish textile designs by employing various techniques including mechanical methods, such as stone-washing, and/or chemical methods, such as enzyme-washing (see U.S. Pat. Nos. 4,912,056 to Olson, and 5,006,126 to Olson et al.). A typical method used by industrial laundries for producing stylish jeans garments by means of the stone-wash method proceeds as follows.

Finished ready-to-wear garments are turned inside out and pre-washed and/or desized. The garments are then removed from the washing machine, turned right side out and are washed in a suitable machine with calcareous sandstone (pumice stone) in a weight ratio of 1:3, i.e., 1 kg garments: 3 kg stone. The garments are then removed from the machine, the stones are removed, and the garments are bleached with sodium hypochlorite to produce a desired shade of color, see Peter, M., et al., *Grundlagen der Textilveredelung* [Basics of Textile Finishing], 13th ed., Deutscher Fachverlag, 1989, pps. 80 to 81.

In the jargon of textile finishing, this type of processing of ready-to-wear goods comes under the term "fully fashioned" finishing.

In accordance with DE-A1-38 33 194, when dyeing textile materials made of cellulose fibers or containing cellulose fibers mixed with synthetic fibers, vat dyestuffs in an aqueous alkaline medium in the presence of reducing agents and, if required, further conventional auxiliary agents, are used at temperatures of, for example, 45° to 60° C. Dyeing is subsequently completed in that the textile material is rinsed, oxidized and washed.

The structural principle of indigoid dyestuffs can be generally described by the following formula:

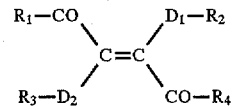

in which $D_1$=$D_2$=NH=indigoid dyestuff in the narrower sense; $D_1$=$D_2$=S=thioindigoid dyestuff; and $R_1$ to $R_4$=chemical structural elements.

The installation of these chemical structural elements R, D and CO into heterocyclic rings results in stable, technically usable dyestuffs, such as the classical indigo, which is registered in the Color Index under the identification C.I. Vat Blue 1 or C.I. Pigment Blue 66, and is commercially available.

The numerous representatives of indigoid dyestuffs are being traded as so-called vat dyestuffs and, less frequently, as pigments. The dyestuffs obtainable by the direct halogenation of indigo have proven themselves to be particularly useful indigo derivatives, such as C.I. Vat Blue 41, C.I. Vat Blue 5, C.I. Vat Blue 37, C.I. Vat Blue 35, C.I. Vat Blue 48 or C.I. Acid Blue 74. Blue tones with a greenish cast are created if, for example, indigo is chlorinated or if hypochlorite is used for bleaching.

Vat dyestuffs are practically insoluble in water and must be made water-soluble prior to dyeing by reduction in an alkaline solution. The reaction product obtained, also called a leuco base or a vat salt, is absorbed by the substrate and now can be reoxidized to the dyestuff. Vat dyestuffs therefore contain chemical structural elements which, in the oxidized form, make the molecule insoluble in water and, in the reduced form, which can be obtained reversibly, make it soluble in water.

Up to now, the removal of these vat dyestuffs from denim garments by the employment of hypochlorite or bleaching lye was customary. Based on Order No. 609 issued by the Federal Ministry for Agriculture and Forestry of Austria regarding the "Limitation of Waste Water Discharge from Textile Finishing and Processing Plants", Federal Law Gazette, No. 207 of Sep. 24, 1992, however, use of hypochlorite must now be minimized in accordance with Sect. 33a of the Water Rights Law (WRG). The free chlorine content of waste water from such plants, calculated as $Cl_2$, is not permitted to exceed 0.2 mg/l, and absorbable, organically bound halogens (AOX), calculated as Cl, are not permitted to exceed 0.5 mg/l. In the course of the conventional production of stone-washed denim, however, considerable amounts of active chlorine remain in the bleaching bath. For example, organic molecules are created during chlorination of the vat dyes, which are removed along with the washing bath and are identified as AOX in the waste water.

The use of hypochlorite-containing bleaching liquor furthermore has the disadvantage that some vat dyestuffs result in a blue with a greenish cast when the dyestuff molecule is chlorinated.

When dyeing textiles in general, the objective is to obtain the most even coloration possible and an equal absorption of the dyestuff by the textile fibers. Up to now, it was possible to make the vat dyestuffs water-soluble in the form of a leuco base by means of reducing agents and also mixtures of reducing agents, however, such dyestuffs are simultaneously absorbed by the textile fibers. Sodium dithionite, hydroxymethane sulfinic acid, thiourea dioxide (formamidine sulfinic acid) or mixtures of these compounds have been used in the art as reducing agents. For example, it is known to use thiourea dioxide (formamidine sulfinic acid) as a reducing agent in textile dying and stripping applications in place of sodium hydrosulphite from Das et al., "Thiourea dioxide: A powerful and safe reducing agent for textile applications", *COLOURAGE*, Vol. 31, No. 26, 1984, pps.15–20, and from Weiss, "THIOUREA DIOXIDE: A Safe Alternative to Hydrosulfite Reduction", *AMERICAN DYESTUFF REPORTER*, Vol. 67, No. 8, August 1978, pps. 35–38, and No. 9, September 1978, pps. 72–74. When employed as a dye stripping agent, a leveling agent, such as a blended anionic and non-ionic compound, generally facilitates stripping action according to Das et al.

Excessively strong reducing agents cannot be used, however, because the dyestuff may be over-reduced and possibly destroyed as described in DE-A1-20 11 387. In accordance with DE-A1-38 33 194, alpha-hydroxycarbonyl compounds have been employed to avoid over-reduction.

The best known reducing agents used in vat dyeing of cellulose fibers are sodium dithionite, formamidine sulfinic acid (thiourea dioxide) and hydroxyacetone. It is known from DE-A1-20 11 387, for example, to employ formamidine sulfinic acid in vat dyeing of textiles containing cellulose fibers. As is further known from this Patent, the reduction of the vat dyestuffs can additionally be performed in the presence of glucose in order to prevent the "over-reduction" of delicate dyestuffs. The evenness of the vat dyeing is described as needing improvement, however.

In DE-A1-38 33 194 the task of dyeing textile materials made of cellulose fibers with vat dyestuffs is performed in that combinations of the components (a) sodium dithionite and/or formamidine sulfinic acid and (b) alpha-hydroxycarbonyl compounds at a weight ratio of 1:1 to 1:15 are used as a reducing agent mixture, and dyeing is performed at pH values of at least 13 and at temperatures above 75° C.

Customary methods used in textile dyeing cannot be employed for bleaching the blue-dyed warp yarn of denim, however, when the objective is to maintain the undyed weft yarn of denim garments substantially white as is desired when a fashionable worn look is sought. Back-staining of the undyed weft yarn, i.e., absorption or deposition of dyestuff stripped from the dyed warp yarn of the denim during bleaching, must be minimized in order to achieve the fashionable worn look. The objective is to lighten the shade of the warp yarn, but its depth is not to be changed.

It is known to obtain a "stone-washed" distressed look in clothing, particularly denim garments, by chemical action. For example, U.S. Pat. No. 5,006,126 to Olson et al. employs, for this purpose, a gelled composition admixed with water which consists essentially of from about 25–90 wt % of a cellulase enzyme and from about 0.01–10 wt% of a thickener selected from the group consisting of a hydratable alkali metal or alkaline earth metal inorganic salt, a polyethylene oxide polymer, a polyvinyl alcohol polymer, a polyvinylpyrrolidone polymer, a polyalkyloxazoline polymer, a xanthum gum and mixtures thereof.

It is additionally known to remove unwanted substances from a dying process using the adsorption capacity of certain substances, for example, polyvinylpyrrolidone, included along with a surface active agent into a foam applied at an elevated temperature to a fabric as disclosed in U.S. Pat. No. 4,314,804 to Fennekels et al.

Known also from U.S. Pat. No. 5,366,510 to Eric Wasinger is a process for simultaneous desizing and partial decolorization of denim fabric and garments using a reducing agent such as thiourea dioxide. A dye complexing agent such a polyvinylpyrrolidone may be added to prevent redeposit of the degraded dye. The process is particularly suitable for pretreating starch-sized fabrics which are then subsequently decolorized with oxidizing agents such as hypochlorite or ozone.

It is further known to promote uniformity of the resulting colored fabric product in a bleaching process employing a chlorine bleaching agent by immersing the fabric or garments to be bleached in an aqueous solution containing from about 0.01 to about 10 grams per liter of a polyacrylic acid followed by addition of the bleaching agent as disclosed in U.S. Pat. No. 4,852,990 to Patterson.

It is therefore an object of the present invention to avoid the above-mentioned disadvantages of prior art bleaching methods for denim and to provide a method for chlorine-free bleaching of denim textile material in order to minimize chlorine and organic chlorine compounds in the waste water.

It is a further object of the present invention to provide an improved method of bleaching denim with a bleaching agent composed of formamidine sulfinic acid, at least one reducing carbohydrate, or mixtures thereof to produce an aesthetic worn look, i.e., an evenly lightened denim, without coloring the undyed, substantially white weft yarn (back-staining) and without changing the depth of shade of the warp yarn.

It is yet another object of the present invention to provide a method of bleaching denim which provides a fashionable gray cast to denim.

SUMMARY OF THE INVENTION

These and other objects are accomplished by the present invention which provides a method for chlorine-free bleaching of denim textile material composed of warp yarn which is dyed with at least one of (a) indigo dye, (b) indigo dye and at least one sulfur dye, (c) at least one indigo derivative dye, and (d) at least one indigo derivative dye and at least one sulfur dye, and weft yarn which is undyed and substantially white and which continues to be substantially white after bleaching. The method comprises the steps of (a) placing denim textile material in water and heating; (b) adding to the water a dispersing agent which is effective to retard deposition of dyestuff stripped from the warp yarn during bleaching onto the weft yarn and which is comprised of polyvinylpyrrolidone; and (c) bleaching the denim textile material by adding to the water a bleaching solution which is aqueous and alkaline, and which is comprised of water and a bleaching agent which is selective for the indigo dye or the indigo derivative dye of the warp yarn and which is selected from the group consisting of formamidine sulfinic acid, at least one reducing carbohydrate, and mixtures thereof.

Advantageously, the inventive method provides an aesthetic worn look to denim textile materials in keeping with contemporary style preference by bleaching dye from the warp yarn while avoiding redeposition of dyestuffs removed from the warp yarn during bleaching onto the undyed, substantially white weft yarn (back-staining) so that the weft yarn continues to be substantially white. When the denim textile material is dyed with indigo dye or an indigo derivative dye and a sulfur black dye, moreover, the inventive method additionally provides a stylish gray cast to the finished denim because the bleaching solution is selective for the indigo dye or indigo derivative dye and the influence of the sulfur black dye becomes progressively more pronounced.

An advantage of the formamidine sulfinic acid/reducing carbohydrate bleaching agent according to the invention is the retardation of the bleaching process to make it more controllable. The reducing carbohydrate, moreover, acts as a redox buffer thereby avoiding over reduction of the indigoid dyestuff which would otherwise tend to produce a generally undesirable greenish tint. An advantage of the dispersing agent according to the invention which includes polyvinylpyrrolidone is that back-staining may be substantially avoided.

The dispersing agent may advantageously additionally contain at least one polymeric substance selected from the group consisting of polyvinyl alcohol, polyacrylates, polyacrylamides, and copolymers of maleic acid and acrylic acid.

Examples of commercially available polyvinylpyrrolidone (PVP) useful as the dispersing agent include RETINOL A and RETINOL M made by CHT, CLEAR STRIP C made by Sybron, and LUVISKOL K 30 and LUVISKOL VA 73 made by BASF. Useful PVP homopolymers have a molecular weight range of from about 9,000 to about 1,200,000, preferably from about 30,000 to about 350,000. Useful PVP copolymers include 70:30 vinyl pyrrolidone(VP)/vinyl acetate(VA) having a MW of about 33,000, and 60:40 vinyl pyrrolidone(VP)/vinyl acetate(VA) having a MW ranging from about 30,000 to about 40,000.

Examples of commercially available polymeric materials useful in addition in the dispersing agent include polyacrylates (PAA), such as ACUSOL 445 made by Rohm & Haas, WJ92, WJ206, and WJ222 made by Rhone Poulenc, and DEGAPAS 4104 No. POC 2020 made by Degussa; coploymers of acrylic acid and maleic acid, such as SOKALAN made by BASF; polyamide polymers such as LIVERCEL DIN made by Polygon Chemie. Useful PAA(s) have a molecular weight ranging from about 4,000 to about 50,000, preferably from about 10,000 to about 40,000.

The dispersing agent may advantageously contain conventional surface active agents as well and such surface active agents are well known in the art. For example, low foaming nonionic surfactants, such as alkanol ethoxylates, may be employed. Examples of useful surfactants include alkanol ethoxylates which are nonionic and low foaming, such as STEPANTEX DA-6, MAKON NF-S, and MAKON NF-12 made by Stepan.

The dispersing agent is added in an amount which is effective to retard deposition of dyestuff stripped from the warp yarn during bleaching onto the weft yarn. For example, the dispersing agent may be added in an amount ranging from about 0.05 to about 2% based on the weight of the dry denim textile material. Preferably, the dispersing agent is added in an amount ranging from about 0.2 to about 0.5% based on the weight of the dry denim textile material. Most preferably, the dispersing agent is added in an amount of about 0.3% based on the weight of the dry denim textile material. The dispersing agent may be added as a solution in water, although solvents in addition to water may be employed to solubilize the dispersing agent, for example, alcohols, such as ethanol.

Preferably, the bleaching agent is formamidine sulfinic acid and at least one reducing carbohydrate in which the formamidine sulfinic acid and the at least one reducing carbohydrate having a weight ratio with respect to one another ranging from 1:99 to 99:1. The reducing carbohydrate may be selected from the group consisting of monosaccharides, such as fructose and glucose, and disaccharides, such as sucrose and molasses, but certain oligosaccharides and polysaccharides, for example, pectin, may be used as well. The polysaccharide starch is not useful, however, since it is not considered to be a reducing carbohydrate as a practical matter and is excluded from the practice of the invention.

Bleaching may be advantageously conducted at a weight ratio (liquor ratio) of bleaching solution to dry denim textile material ranging from 1:1 to 1:40, preferably from 1:5 to 1:10.

Bleaching may be advantageously conducted at a temperature of at least 700° C., preferably at a temperature ranging from 71° to 85° C., and most preferably at a temperature ranging from 72° to 80° C.

Bleaching may be advantageously conducted at a pH which ranges from 10 to 13, preferably at a pH which ranges from 10.5 to 12.5, and most preferably at a pH which ranges from 11–12. The bleaching solution may further comprise a base, such as an alkali hydroxide, for example, sodium hydroxide, to obtain the desired alkalinity. The pH value is preferably adjusted by the addition of sodium hydroxide.

The method according to the invention further comprises the steps of draining off the bleaching liquor and drying the denim textile material. The method may advantageously further comprise the step of rinsing the denim textile material with water in a plurality of sequential rinses before drying, and at least one rinse of the plurality of rinses may advantageously employ water to which is added from about 0.1 to about 2% of acetic acid and from about 1 to about 3% of hydrogen peroxide, based on dry weight of the denim textile material, whereby any residual alkalinity of the denim textile material is neutralized and any residual reducing agent thereon is completely oxidized.

The method advantageously provides denim textile material having a gray cast when the warp yarn is dyed with a dye including at least one sulfur dye which is a sulfur black dye. Then, selective bleaching of the indigo and/or indigo derivative dyes from the warp yarn results in a graying effect, i.e., a lower lightness, L*, for the same b* number.

DESCRIPTION OF THE PREFERRED EMBODIMENTS

The chlorine-free bleaching method in accordance with the invention is not subject to the previously mentioned disadvantages of prior art bleaching methods employing chlorine, such as the formation of active chlorine and absorbable organic halogens, the over-reduction of the dyestuffs, and excessively high COD (Chemical Oxygen Demand) burdens on the waste water.

It has now been surprisingly found that it is possible to improve the bleaching of denim textile material with a bleaching agent which is selected from the group consisting of formamidine sulfinic acid, at least one reducing carbohydrate, and mixtures thereof by adding to the water bath containing the denim textile material a dispersing agent which is effective to retard deposition of dyestuff stripped from the warp yarn during bleaching onto the weft yarn and which is comprised of polyvinylpyrrolidone. As used herein, "denim textile material" is intended to include denim fabric and finished garments made primarily of denim fabric.

The inventive method may be used in conjunction with other textile treatment methods, such as, for example, stone washing, in which case, after stone removal, the denim is placed into fresh water and the temperature is increased to above 70° C. A metered amount of a solution of dispersing agent is then added. The dispersing agent is preferably, but not necessarily, added before the addition of the bleaching solution to obtain maximum prevention of back-staining. Alternatively, the dispersing agent may be added simultaneously with or shortly after the addition of the bleaching agent. The addition of a metered amount of a prepared bleaching solution then follows. Alternatively, the bleaching solution may be added first, but then it is preferable to add the dispersing agent soon thereafter or even simultaneously. The bleaching solution is comprised of water and a bleaching agent which is selective for the indigo dye or the indigo derivative dye of the warp yarn and which is selected from the group consisting of formamidine sulfinic acid, at least one reducing carbohydrate, and mixtures thereof, and preferably includes a base, such as sodium hydroxide, and, optionally, conventional auxiliary textile agents including dispersants, retardants, wetting agents, and surface active agents (tensides), etc.

The vat dyestuffs in the warp yarn are made soluble in the course of moving the liquor and the denim, and are removed from the warp yarn fibers. The bleaching time ranges from about 1 to 30 minutes, preferably from about 3–12 minutes, and most preferably from about 5 to 10 minutes. The bleaching agent is used in amounts ranging from about 0.5 to 10%, preferably from about 1.0 to 5%, and most preferably from about 2.0 to 4.5% based on the dry weight of the garments, and depending on the desired shade of lightening and the bleaching temperature.

Following bleaching, the liquor is drawn off and the denim is rinsed in water at a temperature ranging from about 40° C. to 60° C. A plurality of rinses are preferably employed and at least one rinse, preferably the second or third rinses, includes the addition of concentrated acetic acid and hydrogen peroxide to the water to neutralize any residual alkalinity and oxidize any residual bleaching (reducing) agent. After rinsing, the denim is typically treated in a softening bath. Subsequently, the denim garments are drained, tumbled and dried.

A further advantage of the method in accordance with the invention is that the denim textile material can be bleached in a highly reproducible manner. The dyestuff is reductively removed from the indigo-dyed warp selectively. The concentrations of the bleaching agent and the dispersing agent can be selected such that back-staining, i.e., coloring, of the undyed, substantially white weft is prevented. In contrast to conventional dyeing, in the present invention, one portion of the fabric, the warp, is decolorized in a controlled manner without the other portion of the fabric, the weft, being simultaneously colored by back-staining. Moreover, the waste water is free of chlorine and absorbable, organically bound halogens (AOX), and the waster water burden is clearly less than with the use of sodium hypochlorite. The vat dyestuff can be recovered from the waste water by acidification.

The following examples are intended to describe the invention without limiting it.

EXAMPLE 1

Formulation of the bleaching solution:

Five l of water at 25° C. were placed into a container with a stirrer, and 60 g of caustic soda, 38 g of formamidine sulfinic acid, and 2 g of sucrose were dissolved in it while stirring.

Bleaching:

Four kg of stone-washed denim garments (blue jeans) and 20 l of water were heated to 750° C. After a temperature of 75° C. was reached, the bleaching solution was added. The liquor was drained off after 15 minutes of agitation in the washing machine and the denim garments were rinsed twice at approximately 400° C. To the second rinse bath was added 2 g/l of acetic acid and 1 g/l of 35% hydrogen peroxide. The garments were subsequently tumbled and dried. The pH value of the liquor was lowered from 13 to 12.3 in the process. The raw denim garments (before bleaching) were measured to have a whiteness (filter R 457) of 8.8 and a yellow value of −98.5. The bleached denim garments had an average whiteness of 19.4 (filter R 457) and a yellow value of −66.5. The warp was clearly lightened and the weft remained pure white. The bleaching liquor had a COD value of 7280 mg of $O_2$/l and was free of absorbable organic halogens (AOX).

EXAMPLE 2

Preparation of the bleaching solution:

720 g of a 50% sodium hydroxide solution and 228 g of formamidine sulfinic acid and 12 g of sucrose were dissolved in approximately 7 l of water while stirring.

Bleaching:

6 kg of stone-washed denim garments and 30 l of water were heated to 80° C. Bleaching solution was added and after 15 minutes of agitation in the washing machine, the liquor was drained off. The vat dyestuff was recovered from the liquor by changing it into a form which is insoluble in water by the addition of acetic acid and hydrogen peroxide, and was recovered from the liquor by filtration. The liquor had a light-yellow color and a COD value of 5000 mg of $O_2$/l. The presence of AOX could not be detected. The denim garments were then washed, rinsed and dried as in Example 1.

The bleached denim garments had a whiteness of 43.7 (raw denim garments 24.0), measured by means of a whiteness-measuring device (filter R 457), and a blue value of −8.8 (raw denim garments −9.9).

This lightness is comparable with denim garments bleached with sodium hypochlorite. By way of comparison, the analysis of the waste water following bleaching with sodium hypochlorite resulted in a COD value of 18600 mg of $O_2$/l.

EXAMPLE 3

66 kg of stonewashed denim garments and approximately 600 l of water were heated to 75° C. 700 ml (approximately 1%) of Sybron Clean Strip C (PVP) solution was added, followed by the addition of a bleaching solution consisting of 3.7 kg NaOH, 2.2. kg formamidine sulfinic acid, and 115 g of sucrose dissolved in 35 l of water. After 10 minutes of bleaching at 75° C., the bleaching liquor was drained off and the denim garments were rinsed twice with hot water. After rinsing, a cold water wash with water containing 2 g/l acetic acid and 1 g/l $H_2O_2$ (35w) was performed, After treatment with a softener, the denim garments were dried.

As can be seen from the data in Table 1, denim fabrics made from differently dyed warp yarns yield different brightness levels and color shades. Brightness, lightness (L*), color factor (a*), color factor (b*), and Chroma E were measured by the Standard ISO CIE Color Code Method which employs the CIEL*a*b* system. The measure of lightness according to this system is L* which varies from 100 for a perfect white to 0 for absolute black. For the color factor $a^*_e$, +a* indicates redness and −a* indicated greenness. For the color factor b*, +b* indicates yellowness and −b* indicates blueness. Chroma E (or Delta E) values are overall color difference values which take into account lightness/darkness differences, as well as chromatic differences. The values are average values measured for the denim fabric as a whole.

Table 2 presents the results of visual evaluation by a panel of three people of back-staining when various dispersing agents were employed in the bleaching method of Example 3. The liquor ratio was 1:10, the temperature was 75° C., and the bleaching solution contained 2.75% FAS and 0.25% sucrose. Visual evaluation is a better method of determining back-staining than the Standard ISO CIE Color Code Method because the ISO Method gives a measurement which is an average measurement for the denim fabric as a whole and is not capable of evaluating the whiteness of the undyed, substantially white weft yarn itself. Substantial back-staining of the weft yarn was observed for the denim control which was bleached without dispersing agent according to the invention, while little or no back-staining was observed for the denim samples bleached by the method according to the invention.

Tables 3 and 4 present the results of plant trial tests to show the effect of using Degussa's Z5™ bleaching agent in the inventive method on brightness and color. Degussa's Z5™ bleaching agent is a proprietary composition containing FAS and sucrose.

Table 5 presents the results of tests to show the effect of temperature of the bleaching step on brightness and color. Degussa's Z5™ bleaching agent was employed as the dispersing agent in the amounts shown.

Table 6 shows the degree of polymerization (DP) values of denim fabric bleached using the inventive method with Degussa's Z5™ bleaching agent compared to denim fabric bleached using a prior art chlorine bleach. Since cotton is a polymer, the DP is a measure of fiber strength. Table 6 shows that bleaching according to the invention preserves the fiber strength significantly better than bleaching with chlorine.

Table 7 compares the chemical oxygen demand (COD) load on the waste water after bleaching denim using the inventive method with Degussa's Z5™ bleaching agent compared to that for denim fabric bleached using a prior art chlorine bleach. The COD load on the waste water of the inventive bleaching method is significantly less than that of the chlorine bleaching method.

EXAMPLE 4

A comparison of bleaching results was made to compare the process of Example 1 of U.S. Pat. No. 5,366,510 to Eric Wasinger and bleaching with a bleaching agent including FAS and 0.02 wt % sucrose but without the addition of the dispersing agent including polyvinylpyrrolidone according to the invention. The results are reported in Table 8. The tests according to Wasinger's Example 1 showed a reduced brightness and no significant bleaching with some back-staining. The presence of sizing appears to have inhibited the access of the bleaching agent which is believed to be due to fixation of the size onto the cellulose fibers under the alkaline conditions employed in Wasinger and which tends to result in non-uniform bleaching. As shown in Table 8, the test using FAS and a reducing carbohydrate as in the present invention resulted in a slightly higher brightness (some bleaching) but with some back-staining. The results indicate that significantly higher concentrations of FAS/FAS-sucrose are required to yield significantly lighter color shades.

TABLE 1

Effect of dying method on brightness and color of denim.

| Fabric No. | Dyeing Process | Brightness (%) | L* | a* | b* | Chroma E |
|---|---|---|---|---|---|---|
| 1 | S. Bottom | 19.6 | 48.15 | −1.4 | −5.8 | 5.97 |
| 2 | S. Top | 22.6 | 48.47 | −2.7 | −11.2 | 11.52 |
| 3 | S. Bottom | 23.0 | 51.44 | −1.8 | −6.5 | 6.74 |
| 4 | 100% indigo | 27.5 | 52.09 | −2.9 | −13.4 | 13.71 |
| 5 | S. Bottom | 28.0 | 53.69 | −2.8 | −11.2 | 11.54 |
| 6 | 100% indigo | 28.5 | 52.78 | −3.2 | −13.7 | 14.07 |
| 7 | S. Bottom | 28.6 | 54.05 | −2.9 | −11.5 | 11.86 |
| 8 | S. Bottom | 28.6 | 54.74 | −2.7 | −10.3 | 10.65 |
| 9 | S. Bottom | 28.7 | 54.96 | −2.6 | −10.1 | 10.43 |
| 10 | S. Bottom | 28.9 | 54.00 | −2.7 | −11.0 | 11.33 |
| 11 | S. Bottom | 30.9 | 56.82 | −2.7 | −10.1 | 10.45 |
| 12 | 100% indigo | 32.1 | 57.19 | −3.4 | −11.3 | 11.80 |
| 13 | S. Bottom | 32.9 | 59.13 | −2.8 | −8.9 | 9.33 |

"S. Bottom" indicates dying by the sulfur bottom technique in which a sulfur dye is applied before the indigo dye.

"S. Top" inaicates dying by the sulfur top technique in which a sulfur dye is applied after the indigo dye.

TABLE 2

Comparison of dispersing agents.

| Dispersing Agent (% on dry wt. of garment) | Back-staining① |
|---|---|
| None (Control) | 5 |
| PVP, 0.5%② | 1 |
| PVP, 1.0%② | 0 |
| PVP, 1.0%③ | 0 |
| PAA, 0.5%④ | 2 |
| PAA, 1.0%④ | 1 |
| PVP/PAA, 0.5%/10.5%③④ | 0 |
| Polyamide, 1%⑤ | 1 |

①Visual evaluation by a panel of 3 people: 0 = no back-staining; 5 = significant back-staining
②CLEAN STRIP C made by Sybron
③RETINOL M made by CHT
④ACUSOL 445 made by Rohm & Haas
⑤LIVERCEL DIN made by Polygon Chemie

TABLE 3

Effect of Degussa's Z5 ™ addition on brightness and color (laboratory tests; denim fabric: 100% indigo).

| Cycle | Z5 ™ (%) | NaOH (%) | Brightness (%) | L* | a* | b* |
|---|---|---|---|---|---|---|
| Desize | — | — | 10.3 | 29.0 | −0.5 | −17.1 |
| Stonewash | — | — | 11.3 | 30.1 | −0.4 | −18.2 |
| Bleach | 2.0 | 3.0 | 22.8 | 44.8 | −2.4 | −18.1 |
| Bleach | 2.5 | 3.7 | 42.0 | 61.3 | −2.5 | −13.7 |
| Bleach | 3.0 | 4.5 | 59.1 | 78.2 | −2.6 | −5.5 |
| Reference/ Chlorine | — | — | 45.8 | 66.8 | −3.3 | −11.7 |

Bleaching conditions: 70° C., 10 min. with 1 wt % CLEAN STRIP C by Sybron used, pretreatment with enzyme and pumice stones.

TABLE 4

Effect of Z5 ™ addition on brightness and color (plant trial; fabric: indigo/sulfur top yarn).

| Cycle | Z5 ™ (%) | NaOH (%) | Brightness (%) | L* | a* | b* |
|---|---|---|---|---|---|---|
| Raw Material | — | — | 10.3 | 29.0 | −0.5 | −17.1 |
| Bleach | 3.2 | 4.7 | 22.6 | 48.5 | −2.7 | −11.2 |
| Bleach | 3.5 | 4.7 | 25.0 | 51.7 | −2.7 | −9.8 |
| Bleach | 4.5 | 6.1 | 30.4 | 58.5 | −2.2 | −6.2 |
| Chlorine | — | — | 33.9 | 56.8 | −4.2 | −14.5 |

Bleaching conditions: 70° C., 10 min.

TABLE 5

Effect of temperature on brightness and color (laboratory tests; 100% indigo)

| Cycle | Temp. (%) | Z5 ™ (%) | NaOH (%) | Brightness (%) | L* | a* | b* |
|---|---|---|---|---|---|---|---|
| Stonewash | — | — | — | 11.3 | 30.1 | −0.4 | −18.2 |
| Bleach | 70 | 2.0 | 3.0 | 22.8 | 44.8 | −2.4 | −18.1 |
| Bleach | 75 | 2.0 | 3.0 | 33.6 | 54.9 | −3.4 | −17.5 |
| Bleach | 70 | 2.5 | 4.0 | 42.0 | 61.3 | −2.5 | −13.7 |
| Bleach | 75 | 2.5 | 4.0 | 48.0 | 65.0 | −3.3 | −12.0 |
| Bleach | 70 | 3.0 | 4.5 | 59.1 | 78.1 | −2.6 | −5.5 |
| Bleach | 75 | 3.0 | 4.5 | 59.3 | 78.2 | −2.6 | −5.5 |

TABLE 6

Degree of polymerization values of fabrics at various process stages.

| | Z5 ™ | Chlorine |
|---|---|---|
| Raw fabric | 2295 | 2295 |
| Stonewash (enzyme & stones) | 2200 | 2200 |
| Bleach | 2150 | 1510 |

TABLE 7

Comparison of COD load in spent bleaching liquors.

| Bleaching Agent (%) | COD① (mg $O_2$/l) | COD② (mg $O_2$/l) |
|---|---|---|
| Z5 ™ (2) | 4875 | 2190 |
| Z5 ™ (3) | 7370 | 2340 |
| Chlorine | 10,000–15,000 | — |

TABLE 8

Comparison (laboratory tests; denim fabric: 100% indigo)

| | FAS (wt %) | Temp. (°C.) | pH | Dwell Time (min.) | L* | a* | b* |
|---|---|---|---|---|---|---|---|
| Wasinger | | | | | | | |
| Raw material | — | — | — | — | 24.4 | 0.0 | −9.9 |
| Bleach 1 | 0.24 | 80 | 10.0 | 20 | 23.6 | −0.7 | −13.6 |
| Bleach 2 | 0.48 | 80 | 10.0 | 20 | 22.6 | −1.0 | −13.8 |
| Invention | | | | | | | |
| Raw material | — | — | — | — | 24.4 | 0.0 | −9.9 |

TABLE 8-continued

Comparison (laboratory tests; denim fabric: 100% indigo)

| | FAS (wt %) | Temp. (°C.) | pH | Dwell Time (min.) | L* | a* | b* |
|---|---|---|---|---|---|---|---|
| Desized | — | — | — | — | 24.5 | −0.1 | −10.0 |
| Bleach 2 | 0.48 | 80 | 5 | 11.5 | 26.5 | −1.2 | −17.3 |

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A method for chlorine-free bleaching of denim textile material composed of warp yarn which is dyed with at least one of (a) indigo dye and at least one sulfur dye, and (b) at least one derivative of indigo dye and at least one sulfur dye, and weft yarn which is undyed and substantially white and which continues to be substantially white after bleaching to provide a denim textile material having a gray cast, the method comprising the steps of:

a. placing denim textile material in water and heating;

b. adding to the water a dispersing agent which is effective to retard deposition of dyestuff stripped from the warp yarn during bleaching onto the weft yarn and which is comprised of polyvinylpyrrolidone; and c. bleaching the denim textile material by adding to the water an aqueous alkaline bleaching agent which contains a bleaching agent which is selective for the indigo dye or the derivative of indigo dye of the warp yarn and which is selected from the group consisting of formamidine sulfinic acid, and a mixture of formamidine sulfinic acid and at least one reducing carbohydrate, wherein the least one sulfur dye includes a sulfur black dye, and wherein the method provides denim textile material having a gray cast.

2. The method according to claim 1, wherein the dispersing agent further comprises at least one polymeric substance selected from the group consisting of polyvinyl alcohol, polyacrylates, polyacrylamides, and copolymers of maleic acid and acrylic acid.

3. The method according to claim 2, wherein the dispersing agent further comprises at least one surface active agent.

4. The method according to claim 1, wherein the mixture has a weight ratio of the formamidine sulfinic acid to the at least one reducing carbohydrate which ranges from 1:99 to 99:1.

5. The method according to claim 4, wherein the weight ratio ranges from 50:50 to 80:20.

6. The method according to claim 4, wherein the weight ratio ranges from 85:15 to 95:5.

7. The method according to claim 4, wherein the at least one carbohydrate is selected from the group consisting of monosaccharides and disaccharides.

8. The method according to claim 7, wherein the at least one carbohydrate is at least one monosaccharide selected from the group consisting of glucose and fructose.

9. The method according to claim 7, wherein the at least one carbohydrate is at least one disaccharide.

10. The method according to claim 9, wherein the at least one disaccharide is sucrose.

11. The method according to claim 1, wherein bleaching is performed with a weight ratio of bleaching solution to dry denim textile material ranging from 1:1 to 1:40.

12. The method according to claim 11, wherein the weight ratio ranges from 1:5 to 1:10.

13. The method according to claim 1, wherein bleaching is conducted at a temperature of at least 70° C.

14. The method according to claim 13, wherein bleaching is conducted at a temperature ranging from 71° to 85° C.

15. The method according to claim 14, wherein bleaching is conducted at a temperature ranging from 72° to 80° C.

16. The method according to claim 1, wherein bleaching is conducted at a pH which ranges from 10 to 13.

17. The method according to claim 16, wherein bleaching is conducted at a pH which ranges from 10.5 to 12.5.

18. The method according to claim 17, wherein bleaching is conducted at a pH which ranges from 11 to 12.

19. The method according to claim 1, wherein the bleaching solution further comprises an alkali hydroxide.

20. The method according to claim 1, further comprising the steps of draining off the aqueous alkaline bleaching solution and drying the denim textile material.

21. The method according to claim 20, further comprising the step of rinsing the denim textile material with water in a plurality of sequential rinses before drying.

22. The method according to claim 21, wherein at least one rinse of the plurality of rinses employs water to which is added from about 0.1 to about 2% of acetic acid and from about 1 to about 3% of hydrogen peroxide, based on dry weight of the denim textile material, whereby any residual alkalinity of the denim textile material is neutralized and any residual bleaching agent thereon is completely oxidized.

23. The method according to claim 1, wherein the dispersing agent is added in an amount ranging from about 0.05 to about 2% based on the dry weight of the denim textile material.

24. The method according to claim 23, wherein the dispersing agent is added in an amount ranging from about 0.2 to about 0.5% based on the dry weight of the denim textile material.

25. The method according to claim 24, wherein the dispersing agent is added in an amount of about 0.3% based on the dry weight of the denim textile material.

26. The method according to claim 1, wherein the dispersing agent is added as a solution in water.

* * * * *

UNITED STATES PATENT AND TRADEMARK OFFICE

CERTIFICATE OF CORRECTION

PATENT NO.: 5,749,923
DATED : May 12, 1998
INVENTOR(S): Vinzenz OLIP and Norbert STEINER It is certified that error appears in the above-identified patent and that said Letters Patent is hereby corrected as shown below:

Title page,

In [63], change "continuation" to - -continuation-in-part- -; and add - -Provisional Application 60/004,961, Oct. 6, 1995- -.

Signed and Sealed this

Twenty-second Day of September, 1998

*Attest:*

BRUCE LEHMAN

*Attesting Officer*

*Commissioner of Patents and Trademarks*